US006546989B2

(12) United States Patent
Coleman et al.

(10) Patent No.: US 6,546,989 B2
(45) Date of Patent: Apr. 15, 2003

(54) SHIFTING WEIGHT BOTTOM RAIL

(75) Inventors: Shannon Coleman, Whitesville, KY (US); Robert E. Fisher, Owensboro, KY (US); Richard Anderson, Whitesville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/042,564

(22) Filed: Nov. 19, 2001

(65) Prior Publication Data

US 2002/0059987 A1 May 23, 2002

Related U.S. Application Data

(60) Provisional application No. 60/252,610, filed on Nov. 22, 2000.

(51) Int. Cl.[7] ..... E06B 9/30
(52) U.S. Cl. ..... 160/173
(58) Field of Search ..... 160/173 R, 121.1, 160/172 R, 174 R, 176.1 R, 177 R, 178.1 R, 168.1 R, 84.05, 89, 405

(56) References Cited

U.S. PATENT DOCUMENTS 2,307,278 A 1/1943 Krantz
5,127,458 A * 7/1992 Schaefer et al. ..... 160/168.1 R
5,285,838 A * 2/1994 Rapp et al. ..... 160/168.1 R
5,320,154 A * 6/1994 Colson et al. ..... 160/121.1
5,375,642 A * 12/1994 Gaber et al. ..... 160/168.1 R
5,655,590 A * 8/1997 Bryant ..... 160/168.1 R
5,769,143 A 6/1998 Morgan et al.
6,047,760 A * 4/2000 Judkins ..... 160/168.1 R
6,105,655 A * 8/2000 Judkins ..... 160/168.1 R
6,412,537 B1 * 7/2002 Voss et al. ..... 160/84.05

FOREIGN PATENT DOCUMENTS

SE 15427/64 8/1966

* cited by examiner

*Primary Examiner*—David Purol
(74) *Attorney, Agent, or Firm*—Theresa Fritz Camoriano; Guillermo Camoriano; Camoriano and Associates

(57) ABSTRACT

A covering for an architectural opening is made for better closure, especially adjacent to the bottom rail. A movable weight is mounted on the bottom rail, so that the weight shifts to the lower side of the bottom rail when the bottom rail is tilted. A lift cord is mounted to support the bottom rail while being freely movable relative to the bottom rail at least in the front-to-back direction. The weight helps shift the bottom rail into the desired position, and, by being freely movable in the front-to-back direction, the lift cord does not interfere with the motion of the bottom rail.

20 Claims, 13 Drawing Sheets

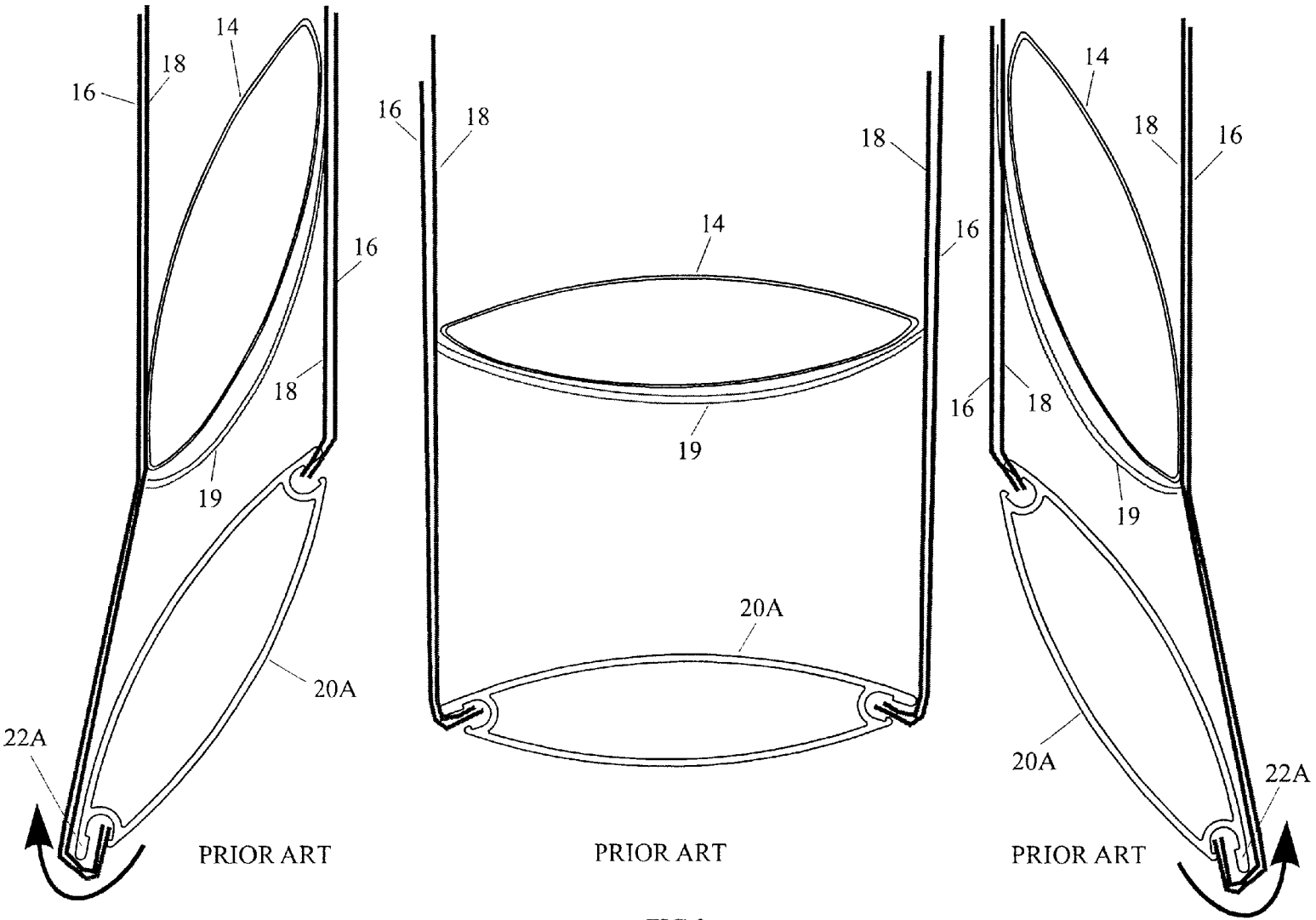
PRIOR ART FIG 4
PRIOR ART FIG 2
PRIOR ART FIG 3

SHIFTING WEIGHT BOTTOM RAIL

This application claims priority from U.S. Provisional Application Ser. No. 60/252,610, filed Nov. 22, 2000.

BACKGROUND OF THE INVENTION

The present invention relates to a bottom rail for a covering for an architectural opening such as Venetian blinds, pleated shades, and other blinds and shades. Typically, a blind transport system will have a top head rail which both supports the blind and hides the mechanisms used to raise and lower or open and close the blind. The raising and lowering is done by lift cords which support the bottom rail (or bottom slat). This bottom rail is normally heavier and larger in cross-section, or more rigid, than any of the slats that are intermediate between it and the head rail. The blind may be tilted in the forward direction and in the rear direction. The tilting is typically accomplished with ladder tapes (and/or tilt cables) which run along the front and back of the blind and are also attached to the bottom rail. By shortening one of the tilt cables relative to the other, the corresponding edge of the blind is lifted up, causing the blind to tilt upwardly in the direction of the shortened tilt cable and downwardly in the direction of the extended tilt cable. The lift cords (in contrast to the tilt cables) may run along the front and back of the stack of slats or through slits in the middle of the slats, and are connected to the bottom rail.

In these constructions, the closure of the blinds (tilting closed) tends to become less effective toward the bottom of the blind. When the blind is fully lowered, all the weight has been lifted off of the lift cords and transferred to the ladder tapes containing the tilt cables. This enables the ladder tapes to have the maximum influence on tilting the bottom rail, which tends to maximize the closure at the bottom of the opening. However, even then, while the shortened cable adjacent to the edge of the blind which is tilted upwardly is under tension, the edge of the blind which is tilting downwardly is under no tension except what little tension gravity can afford, since the tilt cables can only function under tension, but not under compression (you cannot push on a rope). This gravitational influence on the downwardly tilting edge of the blind is partially offset by the ladder tapes, which take some of the weight of each slat away from the extended tilt cable and transfer it to the shortened tilt cable. Thus, the shortened tilt cables support more of the weight and, as a result, tend to stretch more, while the extended cables support less of the weight and thus tend to stretch less. This often results in incomplete closure of the blind.

This situation is aggravated for a product in which the lift cords run along the front and back of the stack of slats. In this instance, when the blind is fully lowered, once again all the weight has been lifted off of the lift cords and transferred to the ladder tapes. However, as soon as the tilting action is started, the edge of the blind which is tilted upwardly is free to rise, but the opposite edge is not free to go downwardly, because, as soon as it starts to do so, it encounters interference from the lift cable. This stops the downward movement of that tilting edge, and the bottom rail stops pivoting around its center and instead begins to pivot about its now fixed, downwardly tilting edge, therefore lifting the center of gravity of this bottom rail and causing poor closure. Thus, in this type of product, the poor closure is due both to a lack of tension on the ladder tapes on the downwardly tilting edge of the bottom rail, and to the interference by the lift cords with the downward motion of the downwardly tilting edge.

The Swedish Patent application SE 15427/64 (filed on Dec. 19, 1964) attempts to address this incomplete closure problem by installing a free rolling weight in the bottom rail. As the bottom rail is tilted, the free rolling weight shifts to one edge of the bottom rail, thus putting the extended tilt cable under increased tension caused by the shifting weight. However, this solution does nothing to alleviate the problem caused by the interference by the lift cords with the downward motion of the downwardly tilting edge in the situation where the lift cords run along the front and back of the stack of slats.

SUMMARY OF THE INVENTION

One example of an embodiment of the present invention provides a bottom rail with a shifting weight and lift cords which support the bottom rail while being free to move in the forward-to-rear direction relative to the bottom rail. In this arrangement, the shifting weight in the bottom rail moves to whatever edge is the downwardly tilting edge of the bottom rail and thus, by increasing the weight at that edge, aids in putting the extended tilt cables under tension, enhancing the closure of the blind. Furthermore, because the bottom rail is free to move in the front-to-back direction relative to the lift cords, the lift cords do not interfere with the tilting of the blind. Thus, the blind closes properly, even at the bottom.

BRIEF DESCRIPTION OF THE DRAWINGS

FIG. 2 is a schematic broken away side view of a conventional prior art bottom rail when in the untilted position;

FIG. 3 is a schematic broken away side view of the conventional prior art bottom rail of FIG. 2 but tilted closed in one direction;

FIG. 4 is a schematic broken away side view of the conventional prior art bottom rail of FIG. 3 but tilted closed in the other direction;

DESCRIPTION OF THE PREFERRED EMBODIMENTS

Figure 1:
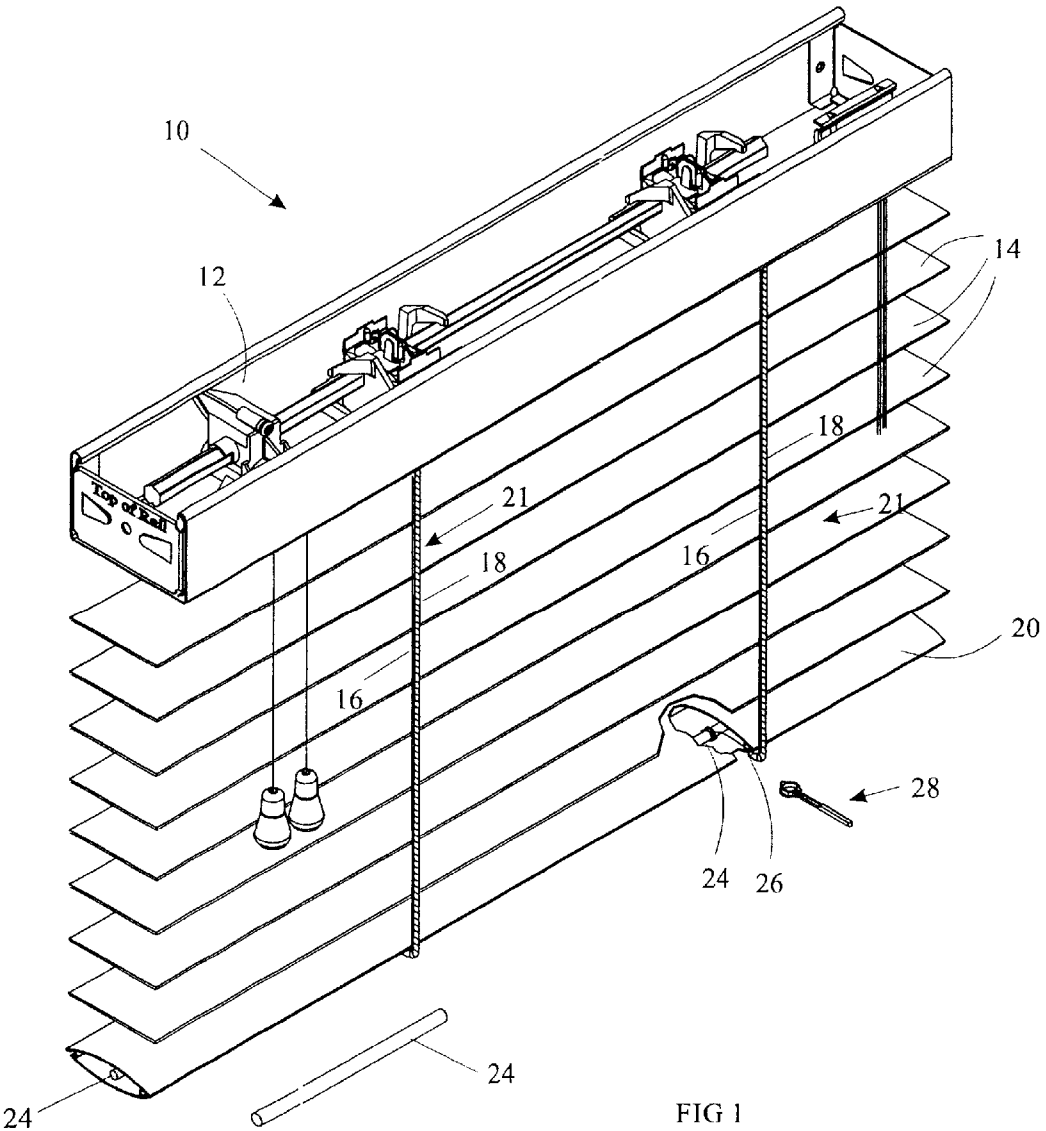
FIG. 1 is a partially broken away perspective view of a blind made in accordance with the present invention.
Figure 7:
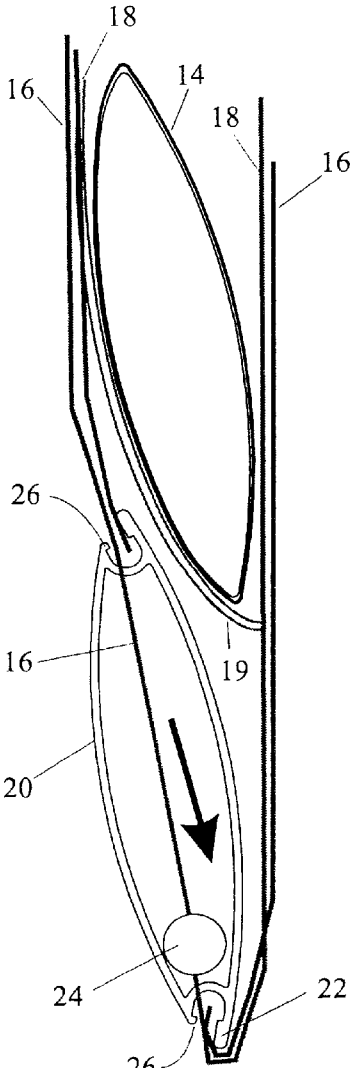
FIG. 7 is a schematic broken away side view of the shifting weight bottom rail of FIG. 6 but tilted closed in the other direction.
Figure 5:
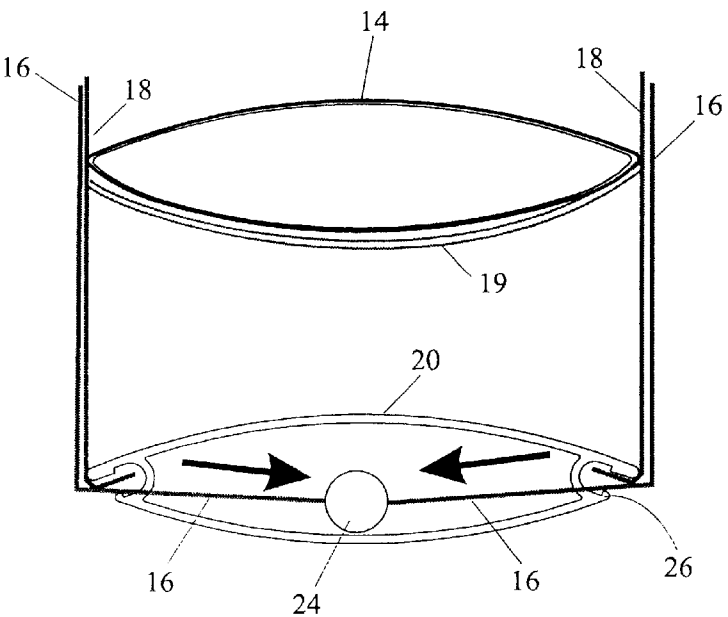
FIG. 5 is a schematic broken away side view of the shifting weight bottom rail of FIG. 1 when in the untilted position.
Figure 6:
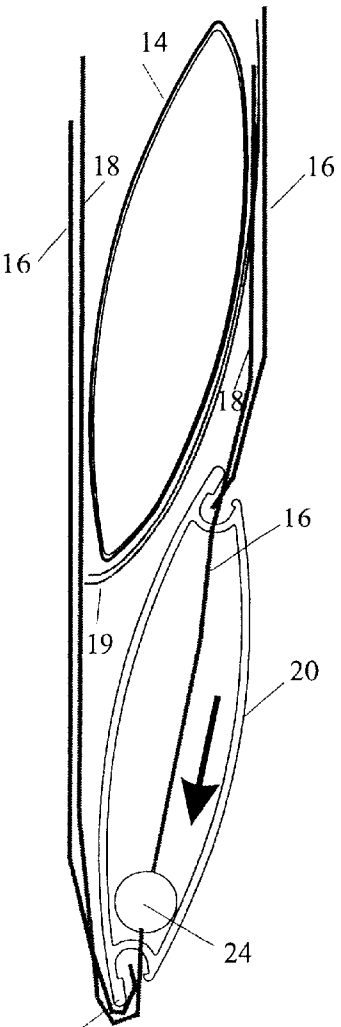
FIG. 6 is a schematic broken away side view of the shifting weight bottom rail of FIG. 5 but tilted closed in one direction.

Referring now to FIG. 1, the blind 10 includes a head rail 12, and a plurality of slats 14 suspended from the head rail 12 by means of tilt cables 18 and the associated cross cords 19 which together comprise the ladder tapes 21. (The cross cords 19 are shown in FIGS. 5–7.) Lift cords 16 extend through the head rail and along the front and back of the stack of slats, and are fastened at the bottom slat (or bottom rail) 20, which is heavier and larger in cross-section, or more rigid, than the other slats 14. Inside the head rail 12 there are one or more drives or mechanisms to raise and lower the lift cords 16, in order to raise and lower the blind, and mechanisms to raise and lower the tilt cables 18 to tilt the blind open or closed, as is known in the art.

FIG. 2 shows a typical prior art bottom rail 20A. In this instance, both the lift cords 16 and the tilt cables 18 are fastened to the front and rear edges of the bottom rail 20A. Since the lift cords 16 do not pass through holes in the slats 14, there are no holes through which light can pass when the blind is closed, which is an advantage. However, as can be appreciated in FIGS. 3 and 4, as the blind is tilted closed, the downwardly tilting edge 22A of the bottom rail 20A is held up by the lift cord 16, which has a fixed length from the head rail 12 to the edge of the bottom rail 20A. Since this edge of the bottom rail 20A is not allowed to drop, but the opposite edge of the bottom rail 20A is being pulled up, the bottom rail 20A begins to pivot around its downwardly tilting edge 22A instead of pivoting around its center. This action tends to raise the center of gravity of the bottom rail 20A, resulting in poor closure of the blind and an arcing of the bottom of the blind.

FIGS. 5, 6, and 7 show one embodiment of a shifting weight bottom rail 20 made in accordance with the present invention. An elongated rod 24, which acts as the shifting weight, is inserted lengthwise along the central portion of the hollow bottom rail 20. The lift cords 16 pass through small slotted openings 26 (See FIGS. 10 and 11), which are present at both the front and rear edges of the bottom rail 20, as will be explained in more detail later, and are attached to the rod 24. The front and rear lift cords 16 may be directly opposite each other, essentially forming a continuous cord, or they may be longitudinally-spaced from each other. By extending through the slots 26, the lift cords 16 extend below at least a portion of the bottom rail 20, in order to support the weight of the bottom rail 20. As the blind is tilted closed (See FIGS. 6 and 7), the lift cords 16 are brought closer together to each other. The lift cords 16 which are on the upwardly tilting edge of the bottom rail 20 are free to slide through the slotted openings 26, allowing the rod 24 to fall toward the downwardly tilting edge 22 of the bottom rail 20. As the rod 24 falls to the downwardly tilting edge 22 of the bottom rail 20, it allows more lift cord 16 to feed out through the slotted openings 26 at the downwardly tilting edge 22 of the bottom rail 20, effectively lengthening the lift cords 16 on the side of the bottom rail 20 adjacent to this downwardly tilting edge 22 of the bottom rail 20. Thus, the bottom rail 20 is allowed to pivot around its center of gravity without being held up by the lift cords 16, and the rod 24 provides an added weight to put increased tension on the ladder tapes 18 on the downwardly tilting edge 22 of the bottom rail 20 to result in a complete closure of the blind.

Figure 8:
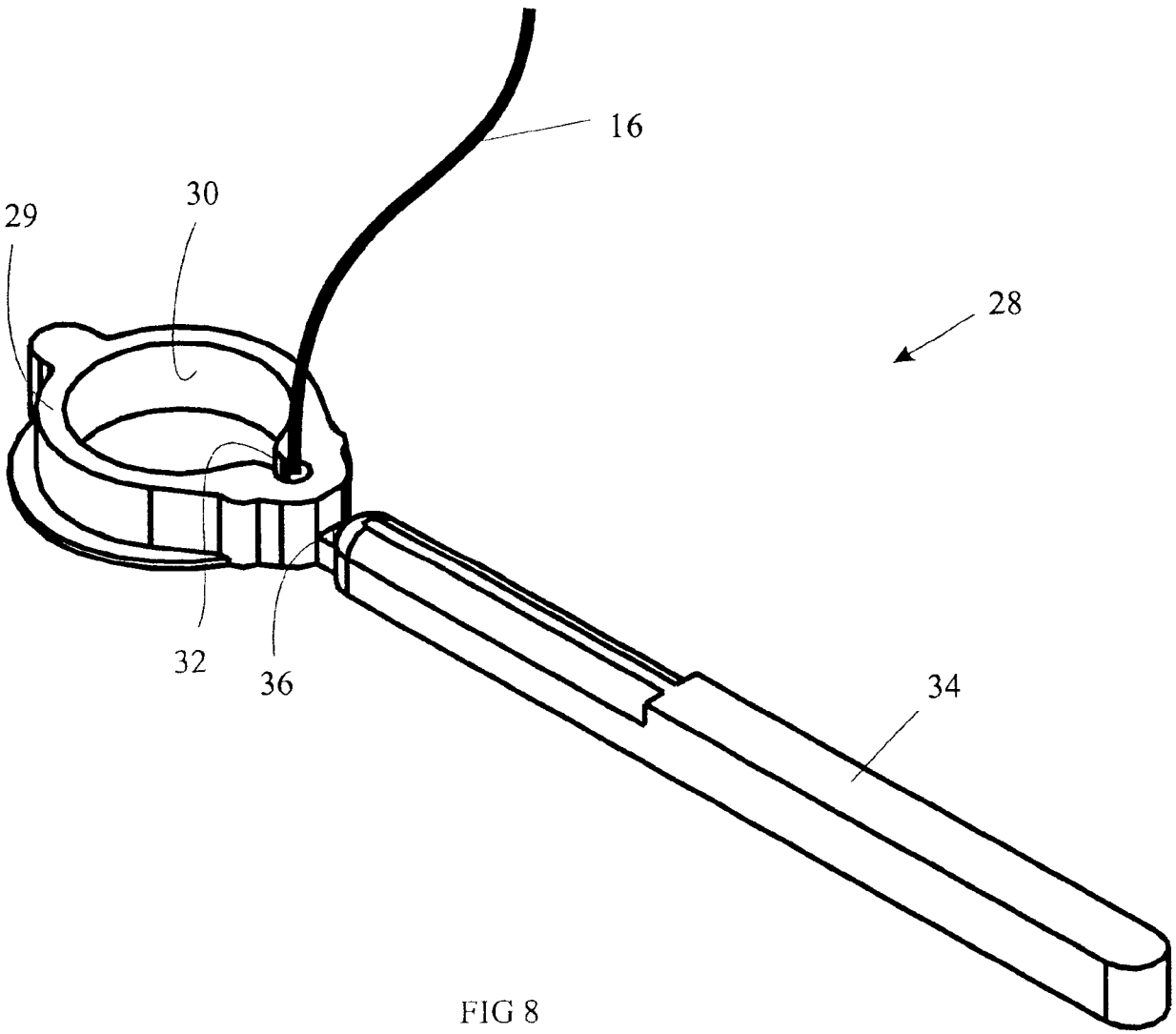
FIG. 8 is a perspective view of a tie off ring used to secure a lift cord to the rod of FIG. 1.

FIG. 8 shows a tie off ring 28 when it is outside the bottom rail 20. The tie off ring 28 may be used to secure the lift cord 16 to the weight 24. The tie off ring 28 includes a head 29 having a substantially annular opening 30 with an inside surface that has a diameter and profile closely matching the outside of the rod 24, so that the rod 24 can be fed through the annular opening 30. A small slotted recess 32 extends from the annular opening 30 and is used to secure the lift cord 16 to the tie off ring 28. In order to secure the lift cord 16 to the tie off ring 28 an enlargement (not shown) such as a knot is secured to the lift cord 16, and then the lift cord 16 is slid through the slot 32, with the enlargement trapped behind the slot 32. Once the rod 24 is fed through the opening 30 of the tie off ring 28, the lift cord 16 will be secured to the tie off ring 28, since the enlargement on the cord 16 will not allow the lift cord 16 to be pulled out. The tie off ring 28 also has a handle 34 which has a narrow neck 36 at the point where the handle 34 joins with the head 29. The neck 36 is a weak link, designed to break away in order to readily separate the head 29 from the handle 34.

Figures 9, 10:
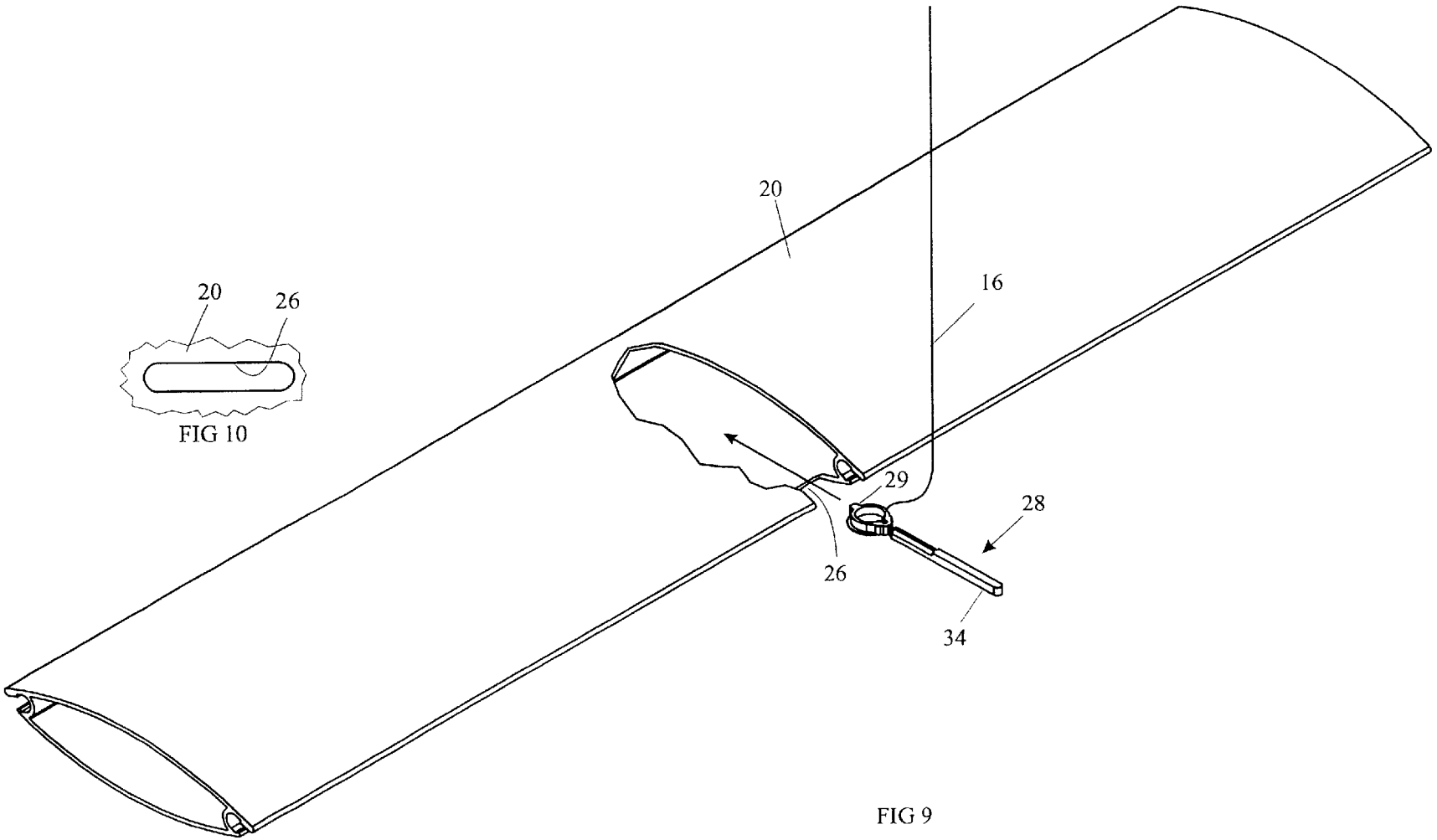
FIG. 9 is a partially broken away perspective view of the bottom rail of FIG. 1 before the tie off ring is inserted through a slot at one edge.
FIG. 10 is a schematic broken-away front view of the bottom rail of FIG. 1 showing the slot used to feed the tie off ring of FIG. 8 into the bottom rail.

FIG. 9 shows the tie off ring 28 with the lift cord 16 attached to it just as it is readied to be inserted into the bottom rail 20 via one of the slotted openings 26 on the front edge of the rail 20. The thickness of the head 29 of the tie off ring 28 is relatively small in relation to its diameter, so that it may be inserted into the bottom rail 20 using a slender slotted opening 26 (See FIG. 10) in the edge of the bottom rail 20. The dimensions of the slender slotted opening 26 are such that it is just slightly wider than the thickness of the head 29 and it is just lightly longer than the diameter of the head 29. The slotted openings 26 are oriented with the long direction in line with the longitudinal axis of the bottom rail 20 and centered vertically in the edge of the bottom rail 20 because this minimizes the adverse effect on the strength of the bottom rail 20 by making such slotted openings 26. When the bottom rail 20 is in a vertical position, it has a very strong beam strength, but when it is in a horizontal position the beam strength is minimized. The slotted openings 26 preferably are located in its neutral web in order to minimize the impact on the beam strength.

Figure 11:
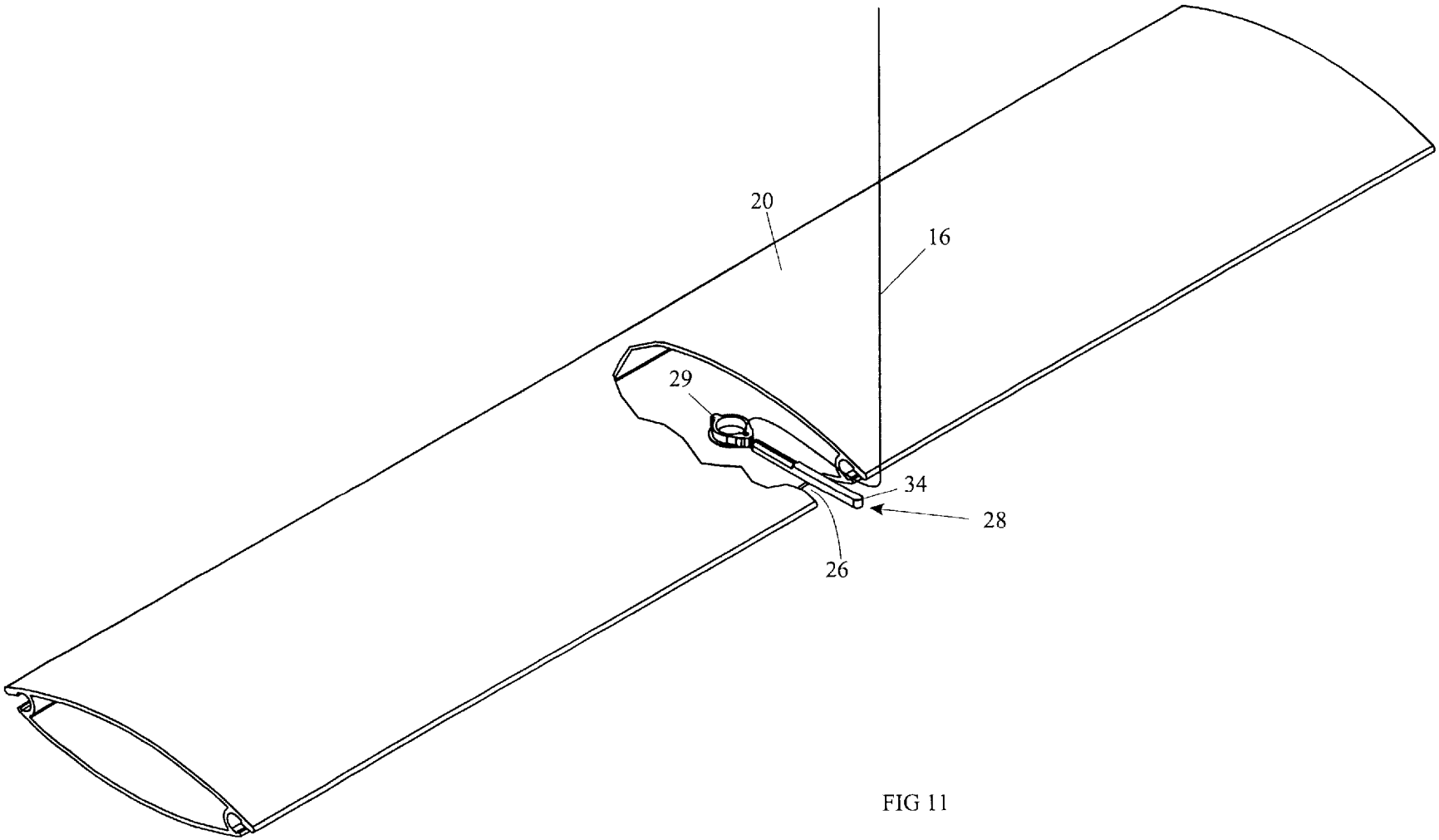
FIG. 11 is the same view as FIG. 9, except the tie off ring has been inserted through the slot of FIG. 10.

FIG. 11 shows the tie off ring 28 inserted into the bottom rail 20, with the head 29 having passed through the slotted opening 26, but the handle 34 still extending out of the slotted opening 26 at the front edge of the bottom rail 20. The lift cord 16, which is secured to the head 29 of the tie off ring 28, is also extending out of the front edge of the bottom rail 20 through the slotted opening 26.

Figure 12:
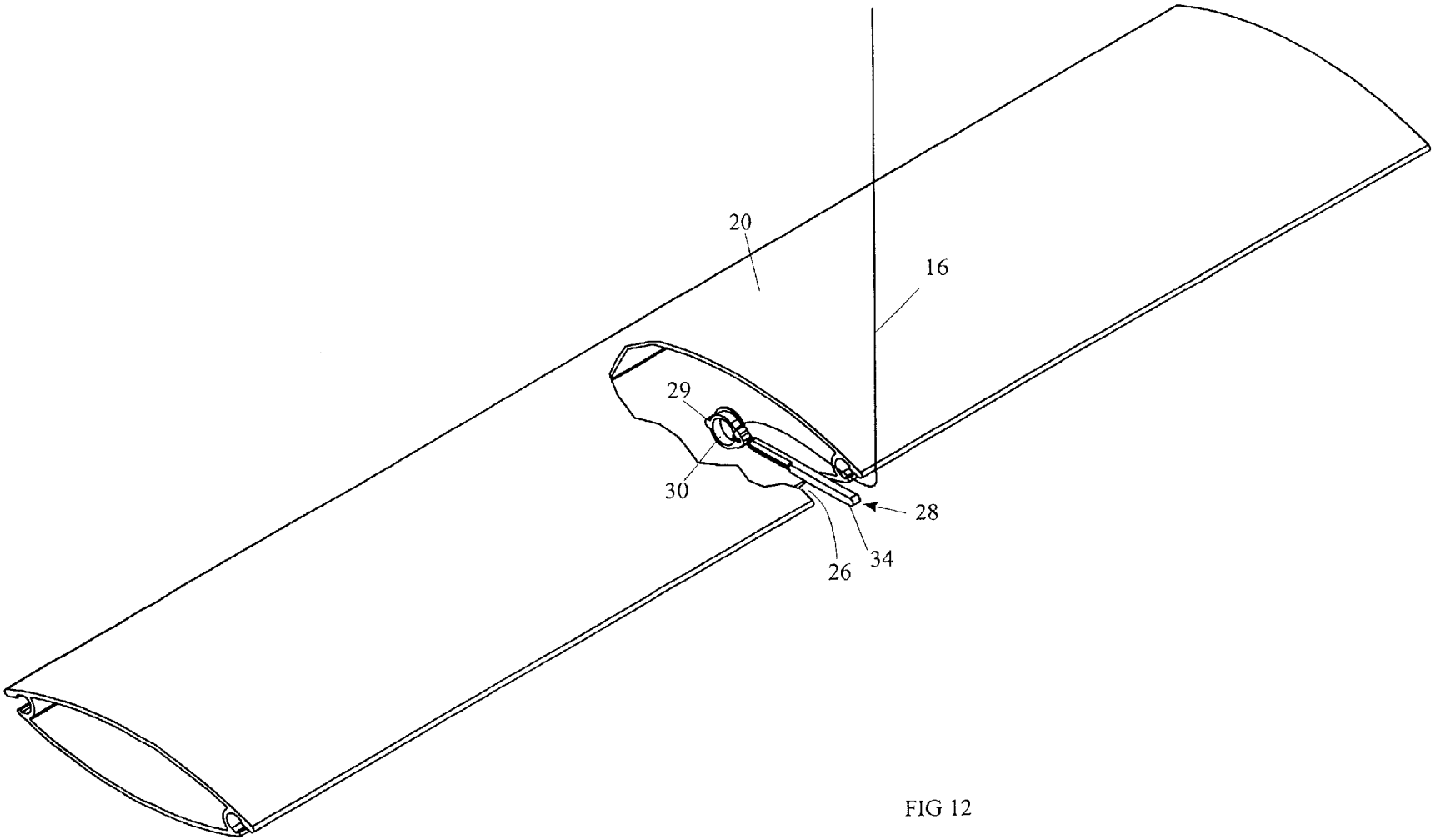
FIG. 12 is the same view as FIG. 11, except the tie off ring has been rotated 90 degrees to align the hole in the ring in readiness to receive the rod.
Figure 13:
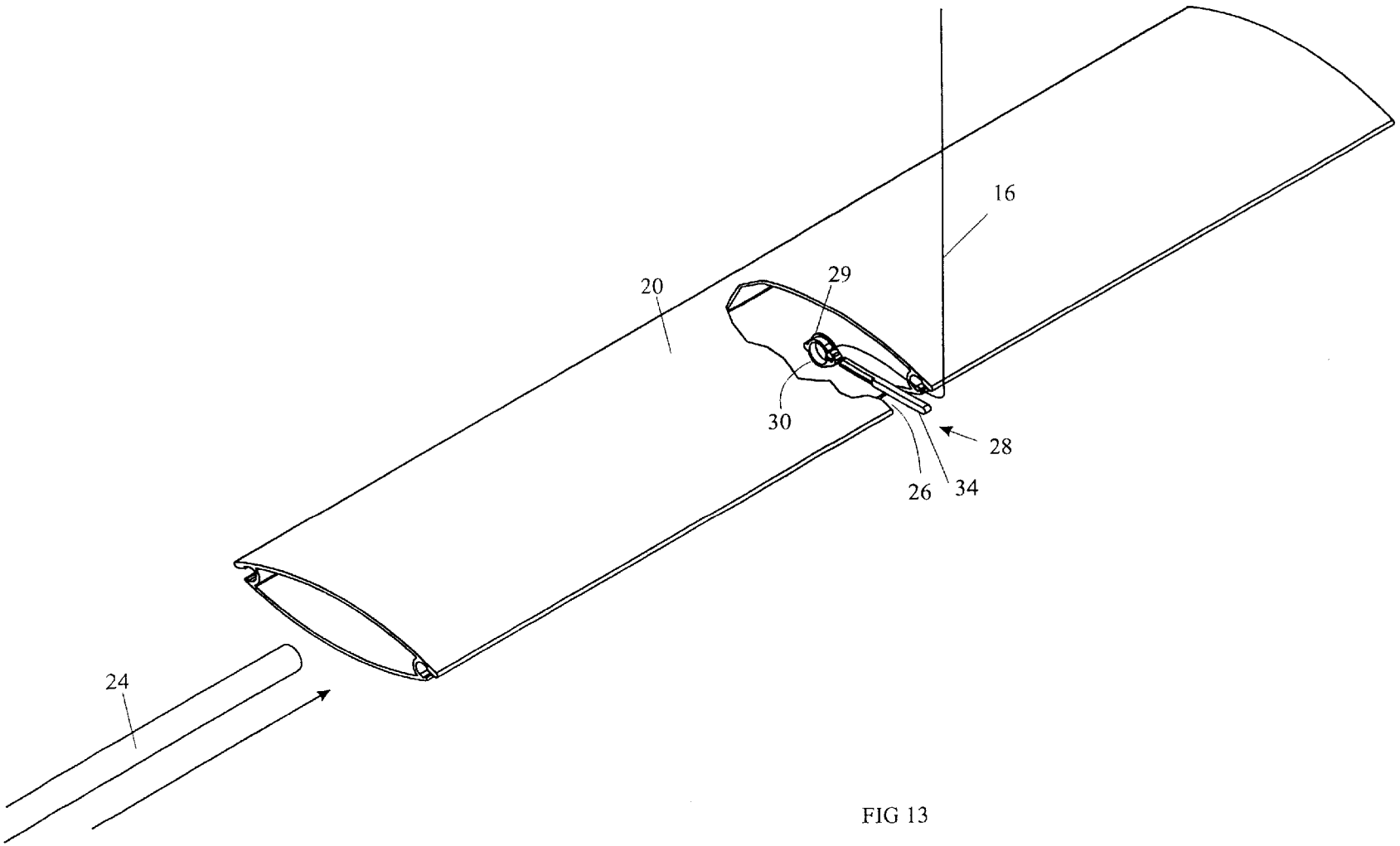
FIG. 13 is the same view as FIG. 12, except it shows the rod being inserted at one end of the bottom rail.
Figure 14:
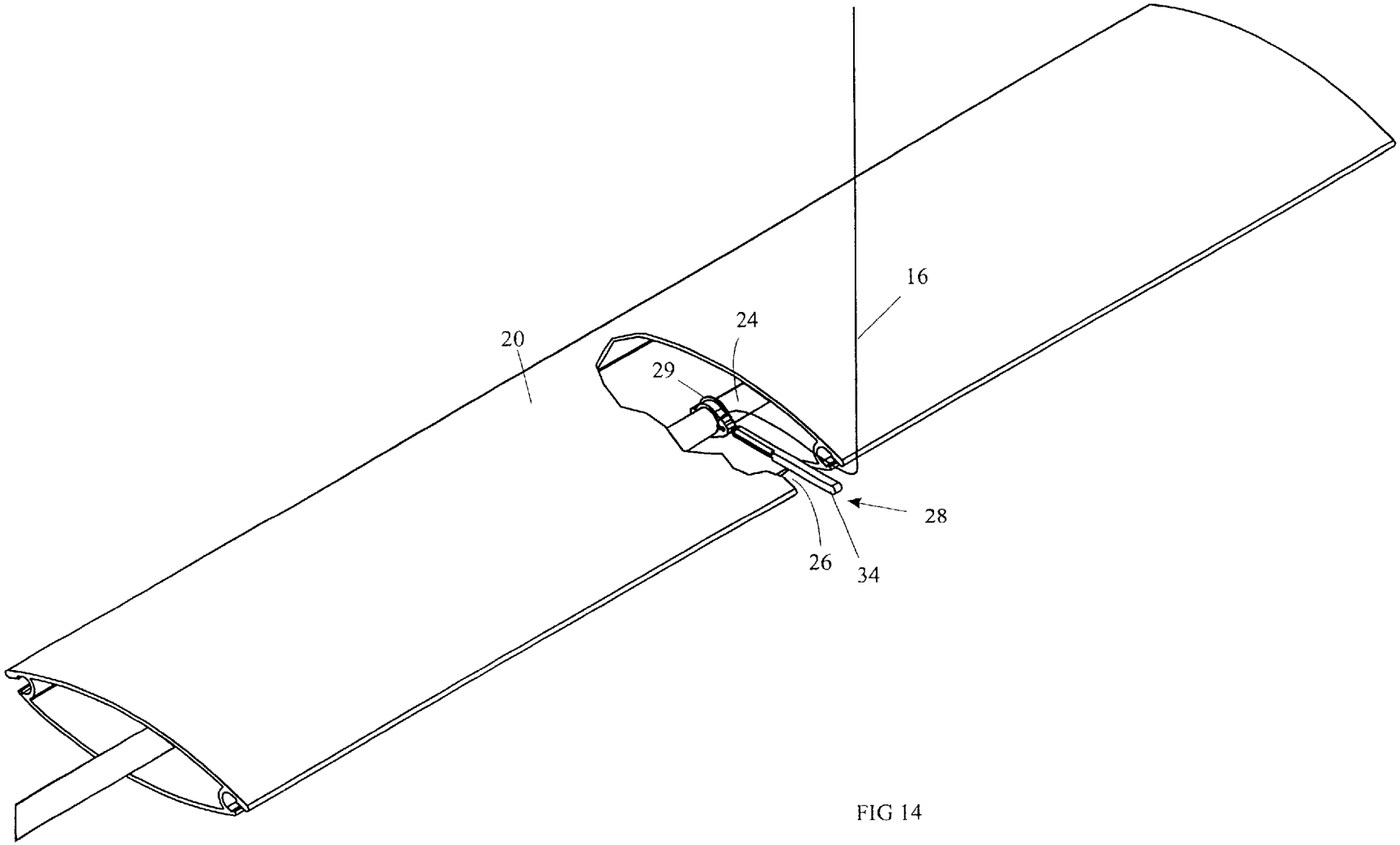
FIG. 14 is the same view as FIG. 13, except it shows the rod threaded through the hole in the tie off ring inside the bottom rail.
Figure 15:
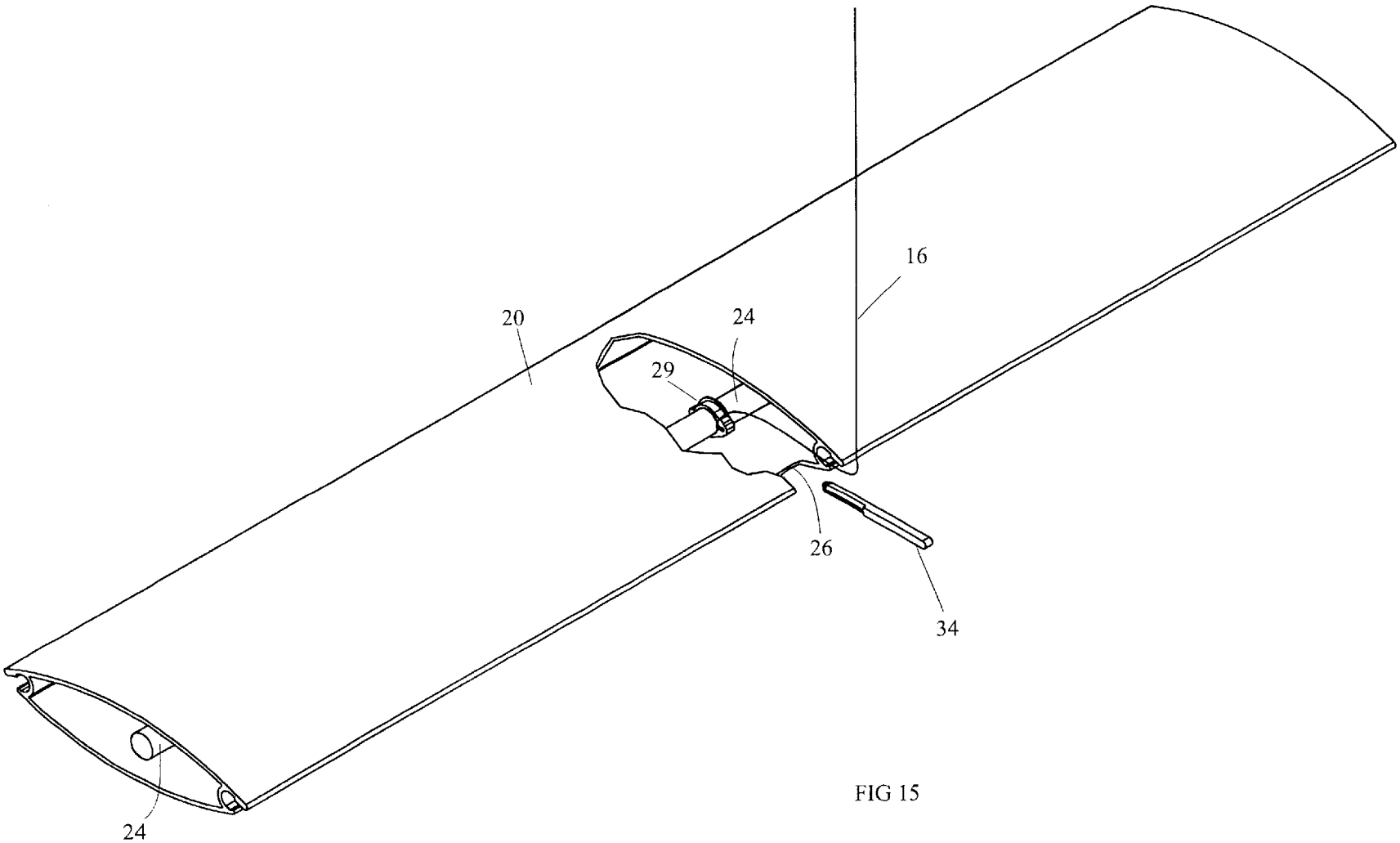
FIG. 15 is the same view as FIG. 14, except it shows the rod totally inserted within the bottom rail, and the ring insertion tab broken off from the tie off ring.

FIG. 12 shows the tie off ring 28 rotated 90 degrees, by rotating the handle 34 about its longitudinal axis. This is done to line up the annular opening 30 with the rod 24 which is inserted from one end of the bottom rail 20 as shown in FIG. 13. FIG. 14 shows the rod 24 after it has been inserted through the annular opening 30 of the tie off ring 28.

Once the tie off ring 28 is secure around the rod 24, the handle 34 is twisted until it snaps off at the weakened point 36. The handle 34 then is removed through the slotted opening 26. The head 29 remains attached to the rod 24, and the lift cord 16 remains attached to the head 29 (and thus now also attached to the rod 24). The lift cord 16 then extends out of the bottom rail 20 via the slotted opening 26. This same process is repeated for as many lift cords 16 as are deemed necessary for a particular blind, and these lift cords may be attached from either edge of the bottom rail 20, either the front edge facing the room or the rear edge facing the wall. End caps (not shown) may be installed at the ends of the bottom rail to hide and confine the rod 24 within the bottom rail 20. After the ladder tapes 18 are connected to the edges of the bottom rail 20, the assembly is ready to operate in the manner which was described earlier. As the blind is tilted closed, the bottom rail 20 pivots around its center of gravity. The bottom rail 20 is not impeded by the lift cords 16, since the lift cords 16 are freely movable in the front-to-rear direction relative to the bottom rail and move with the weight 24. The rod 24 provides an added weight to put increased tension on the ladder tapes 18 on the downwardly tilting edge 22 of the bottom rail 20 to result in a complete closure of the blind as shown in FIGS. 6 and 7. When the blind is tilted open, the action is reversed. The bottom rail 20 once again pivots around its center of gravity, and the rod 24 moves to a position midway between the two edges of the bottom rail 20 as shown in FIG. 5.

ALTERNATE EMBODIMENTS

Figure 16:
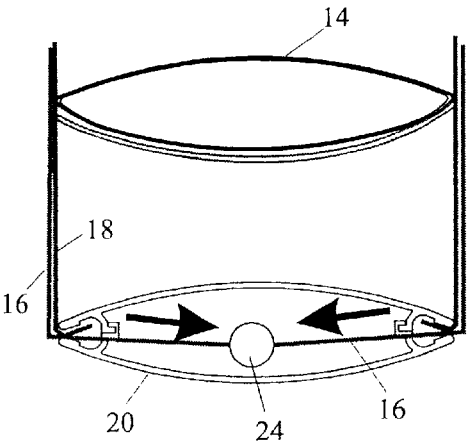
FIG. 16 is the same view as FIG. 5, showing a schematic broken away side view of the shifting weight bottom rail of FIG. 1 when in the untilted position.
Figure 17:
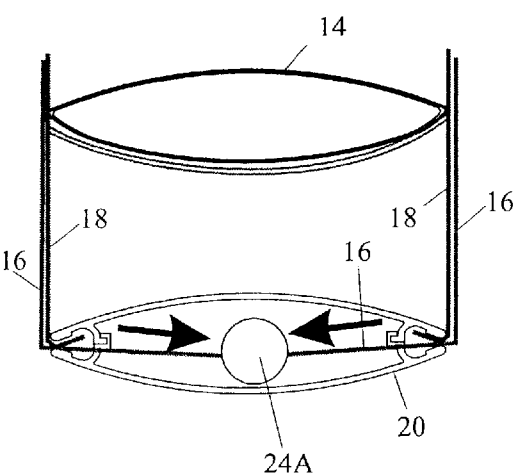
FIG. 17 is similar to FIG. 16, but a plurality of individual balls is used as the shifting weight instead of using a rod.

FIG. 16 depicts the first embodiment of the present invention, with a rod 24 inserted longitudinally inside the bottom rail 20, and the lift cords 16 attached to the rod 24 by means of the tie-off ring 28, as already described above. FIG. 17 depicts the same bottom rail 20 but, in this instance, the shifting bottom weight is made up of a plurality of discrete short rods or spheres 24A. Thus, at each location where lift cords 16 enter the bottom rail 20, a single short rod or sphere 24A may be placed, and the lift cords 16 are secured to these short rods or spheres 24A. These short rods or spheres 24A will likely be of larger diameter than the single rod 24 of the preferred embodiment in order to have sufficient weight to aid in the proper closing of the blind 10.

Since the previously described means for tying off the lift cords 16 to the rod 24 using the tie-off ring 28 will not work for individual spheres 24A, an alternate method for tying the lift cords 16 is employed. If the bottom rail 20 is a "one-piece", enclosed design, as in FIG. 17 (this one-piece design does not count the optional end caps at the ends of the bottom rail 20 as additional pieces), then the lift cords 16 may be "fished" through to the end caps of the bottom rail 20, where they are secured to the spheres 24A before being inserted back into the bottom rail 20. Alternately, the spheres 24A may be modified so that a tie-off hook (instead of the tie-off ring 28) may be latched onto the sphere 24A through an opening in the bottom rail 20.

Figure 20:
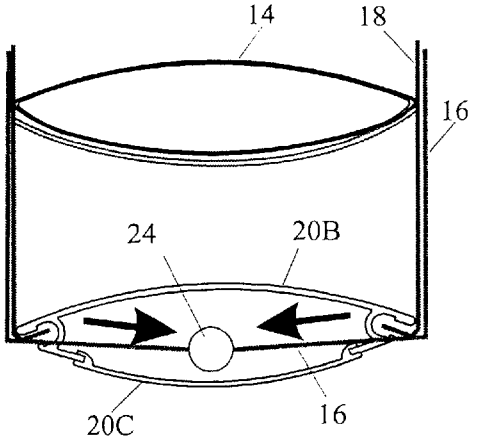
FIG. 20 is similar to FIG. 16, showing a schematic broken away side view of a shifting weight bottom rail when in the untilted position, where the bottom rail is a U-shaped (open bottom) bottom rail with an optional cover.
Figure 21:
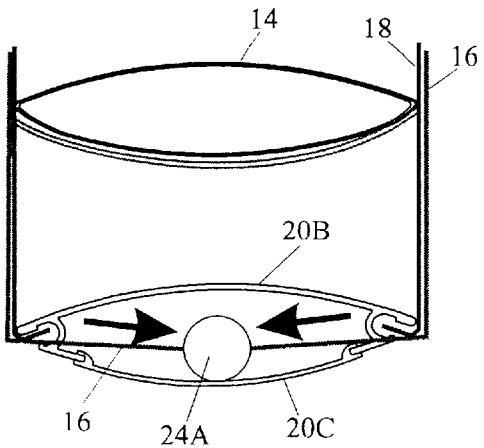
FIG. 21 is similar to FIG. 20, showing a schematic broken away side view of the shifting weight bottom rail but using individual balls as a weight instead of a rod.
Figure 18:
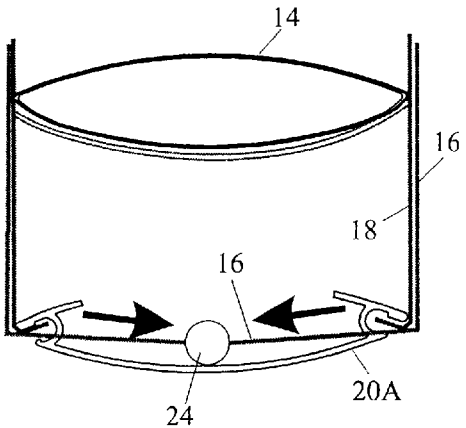
FIG. 18 is similar to FIG. 16, showing a schematic broken away side view of a shifting weight bottom rail when in the untilted position, but the bottom rail is a U-shaped open top bottom rail.
Figure 19:
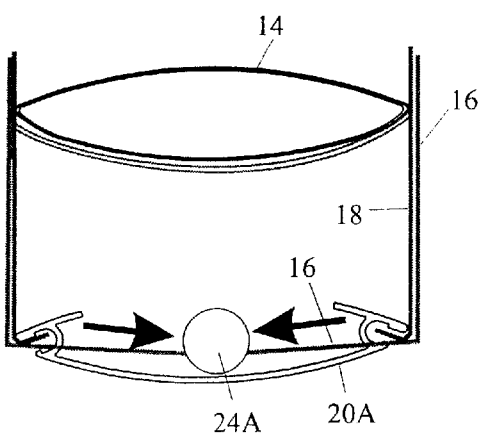
FIG. 19 is similar to FIG. 18, showing a schematic broken away side view of the shifting weight bottom rail but using individual balls as a weight instead of a rod.

Other solutions to the problem of tying off the lift cords 16 to the rod 24 or to the spheres 24A are offered in FIGS. 18–21. FIG. 18 depicts a "one-piece" hollow bottom rail 20A which is a U-shaped "open top" bottom rail. Using this open top bottom rail 20A eliminates the need for using the tie-off ring 28, since the bottom rail 20A is now open, and thus the rod 24 or spheres 24A (See FIG. 19) are readily accessible for securing the lift cords 16 to them. FIG. 20 depicts a "one-piece" hollow bottom rail 20B which is U-shaped and is open on the bottom (instead of on the top as was the case in FIGS. 18 and 19 with bottom rail 20A). This new "open bottom" bottom rail 20B offers the same accessibility for securing the single rod 24 or plurality of individual weight elements 24A to the lift cords 16 without the need for the tie-off ring 28. An optional cover 20C (See FIGS. 20 and 21) may be snapped onto the rail 20B in order to enclose the bottom rail so that it resembles the one-piece, enclosed design bottom rail 20 of the first embodiment while still allowing easy accessibility to its interior space. FIG. 21 shows the same arrangement as FIG. 20 but using a plurality of individual weight elements 24A instead of the rod 24.

Figure 22:
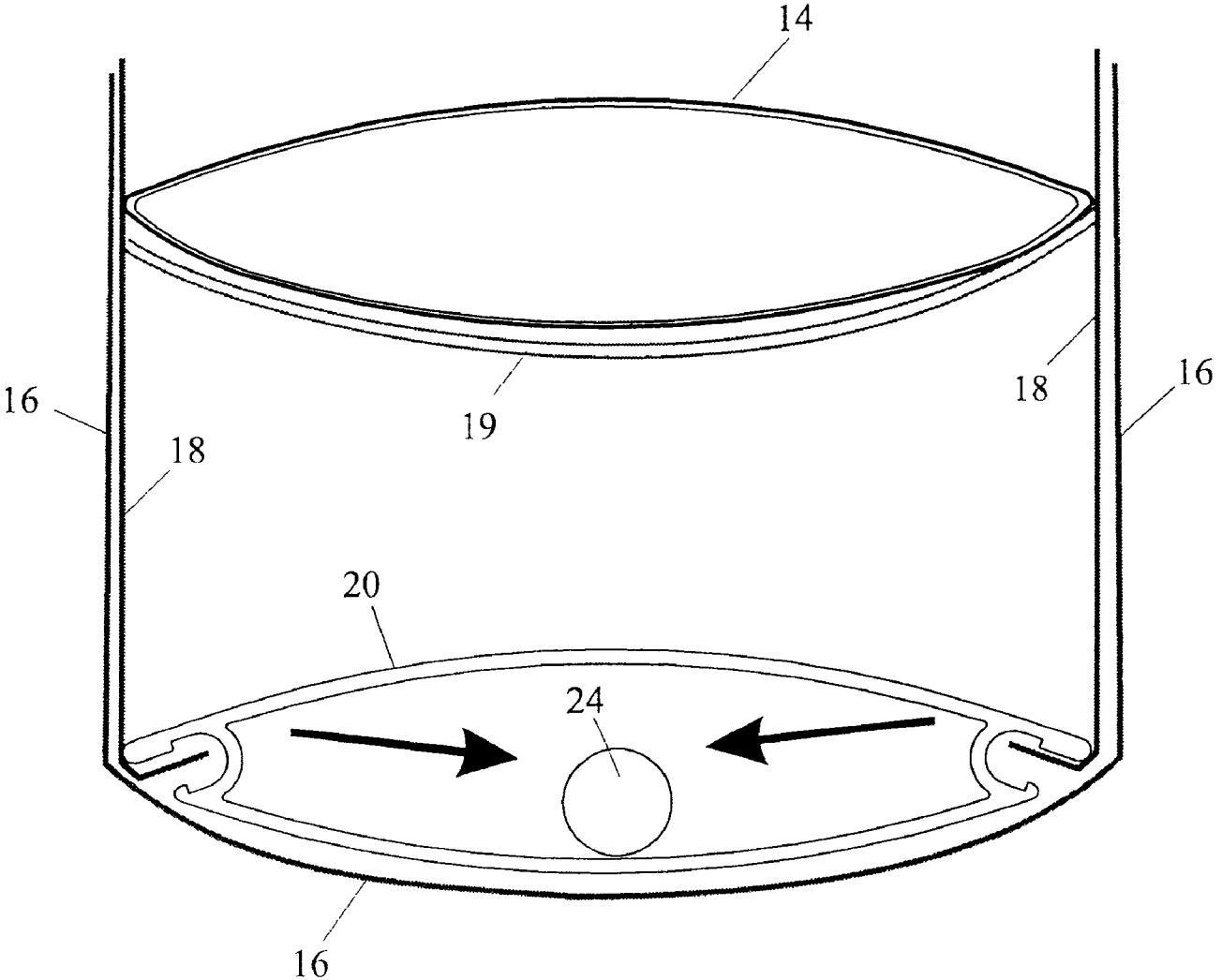
FIG. 22 is a view similar to the view of FIG. 5, but showing an embodiment in which the lift cord extends around the bottom of the bottom rail and is not fastened to the weight.

FIG. 22 shows an alternate embodiment, in which the lift cords 16 extend around the bottom of the bottom rail 20 in order to support the bottom rail 20 while permitting freedom of movement of the lift cords 16 relative to the bottom rail 20. In this embodiment, the rod 24 moves freely in the bottom rail 20 as the tilt cables 18 tilt the blind. The lift cords 16 in this embodiment are not secured to the weight 24.

Figure 23:
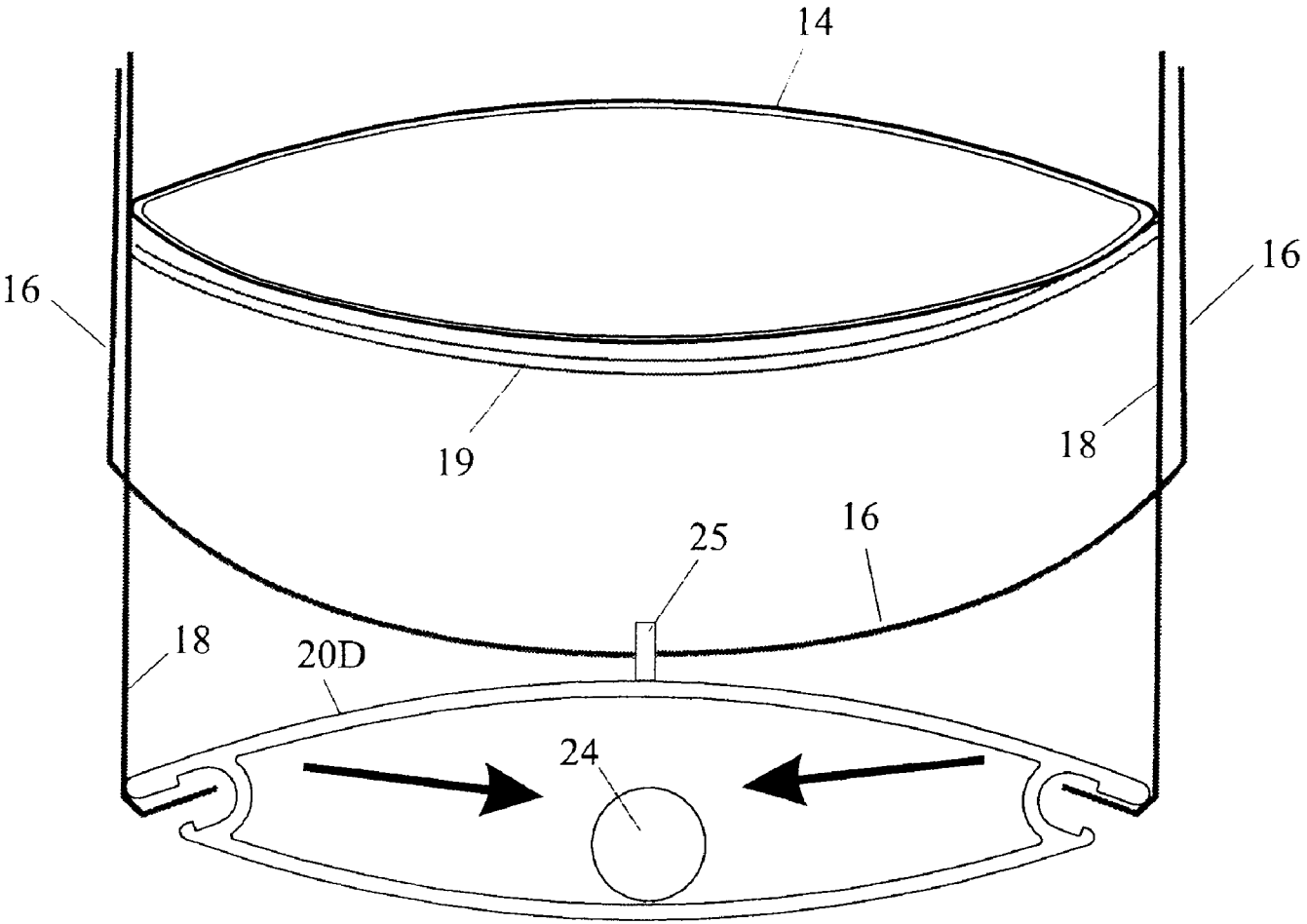
FIG. 23 is a view similar to the view of FIG. 5, but showing an embodiment in which the lift cord extends through an eyelet opening in the bottom rail and is not fastened to the weight.

FIG. 23 shows another alternate embodiment, in which the lift cords 16 extend through respective openings in eyelets 25, which project upwardly from the top surface of the hollow bottom rail 20D. The lift cords 16 thus extend below a portion of the bottom rail 20D in order to support the weight of the bottom rail 20D, while being freely movable relative to the bottom rail in the front-to-rear direction. The weight 24 is freely movable within the rail 20D and is not secured to the lift cords 16.

The embodiments described above are intended for illustration purposes only. They are not intended to show every possible embodiment of the present invention but rather are intended to show some illustrative examples of the present invention. It will be obvious to those skilled in the art that modifications may be made to the embodiments described above without departing from the scope of the present invention.

What is claimed is:

1. A covering for an architectural opening, comprising:

a hollow bottom rail having front and rear edges;

at least one weight movable inside said hollow bottom rail, such that, as the rail is tilted, with one of said front and rear edges shifting to a lower elevation than the other, said weight moves toward the lower elevation edge;

at least one lift cord extending beneath at least a portion of said bottom rail in order to support said bottom rail while being freely movable relative to said bottom rail in at least the front-to-rear direction.

2. A covering for an architectural opening as recited in claim 1, wherein said hollow bottom rail defines a first opening, and said lift cord extends through said first opening.

3. A covering for an architectural opening as recited in claim 2, wherein said lift cord extends into said hollow bottom rail.

4. A covering for an architectural opening as recited in claim 3, wherein said lift cord is attached to said weight.

5. A covering for an architectural opening as recited in claim 3, and further comprising a second opening in said bottom rail, wherein said first opening is in the front of said bottom rail, and said second opening is in the rear of said bottom rail.

6. A covering for an architectural opening as recited in claim 5, and further comprising a second weight movable inside said hollow rail, and a second lift cord attached to said second weight and freely movable relative to said bottom rail in at least the front-to-rear direction.

7. A covering for an architectural opening as recited in claim 1, and further comprising a head rail, from which said one lift cord is suspended.

8. A covering for an architectural opening as recited in claim 7, and further comprising a ladder tape suspended from said head rail, said ladder tape including forward and rear tilt cords, which are mounted on said bottom rail.

9. A covering for an architectural opening as recited in claim 8, and further comprising a plurality of slats, lying between said head rail and said bottom rail, and supported on said ladder tape.

10. A covering for an architectural opening as recited in claim 1, wherein said bottom rail has a bottom surface, and said lift cord extends beneath the bottom surface of said bottom rail.

11. A covering for an architectural opening as recited in claim 2, wherein said bottom rail includes an eyelet projection, which defines said first opening.

12. A method for mounting the bottom rail of a covering for architectural openings having front and rear sides, comprising:

mounting at least one weight on the bottom rail for movement relative to the bottom rail such that, as the rail is tilted, with one of said front and rear edges shifting to a lower elevation than the other, said weight moves toward the lower elevation edge; and extending a lift cord beneath at least a portion of said bottom rail so that said lift cord supports said bottom rail while being freely movable relative to said bottom rail at least in the front-to-rear direction.

13. A method for mounting the bottom rail of a covering for architectural openings having front and rear sides, as recited in claim 12, and further comprising the step of securing said lift cord to said movable weight.

14. A method for mounting the bottom rail of a covering for architectural openings having front and rear sides as recited in claim 12, and further comprising the steps of mounting a plurality of said lift cords on said bottom rail, extending through openings in the front and rear of said bottom rail.

15. A method for mounting the bottom rail of a covering for architectural openings having front and rear sides as recited in claim 14, and further comprising the steps of:

securing said lift cords onto mounting rings;

inserting said mounting rings into respective openings in said bottom rail; and inserting said weight, in the form of an elongated rod, through said mounting rings in order to mount said lift cords on said weight.

16. A method for mounting the bottom rail of a covering for architectural openings having front and rear sides as recited in claim 14, and further comprising the steps of securing said lift cords onto respective separate weights.

17. A method for mounting the bottom rail of a covering for architectural openings having front and rear sides as recited in claim 12, and including the step of extending the lift cord beneath the bottom rail.

18. A method for mounting the bottom rail of a covering for architectural openings having front and rear sides as recited in claim 12, and including the step of extending the lift cord through an eyelet projecting from the bottom rail.

19. A covering for an architectural opening, comprising:

a hollow bottom rail having front and rear edges;

at least one weight movable inside said hollow bottom rail, such that, as the rail is tilted, with one of said front and rear edges shifting to a lower elevation than the other, said weight moves toward the lower elevation edge;

at least one lift cord extending beneath at least a portion of said bottom rail; and means for securing said lift cord to said bottom rail in order to support said bottom rail while permitting free movement of said lift cord relative to said bottom rail in at least the front-to-rear direction.

20. A covering for an architectural opening as recited in claim 19, and further comprising front and rear tilt cables secured to said bottom rail and means for tilting said bottom rail.

* * * * *